US005128000A

United States Patent [19]

Klotz et al.

[11] Patent Number: 5,128,000

[45] Date of Patent: Jul. 7, 1992

[54] DIMENSIONALLY STABLE ANODES AND THEIR USE IN THE PREPARATION OF ALKALI METAL DICHROMATES AND CHROMIC ACID

[75] Inventors: Helmut Klotz, Bergisch-Gladbach; Rainer Weber, Leverkusen; Norbert Lönhoff, Leverkusen; Hans-Dieter Block, Leverkusen, all of Fed. Rep. of Germany

[73] Assignee: Bayer Aktiengesellschaft, Leverkusen, Fed. Rep. of Germany

[21] Appl. No.: 680,602

[22] Filed: Apr. 1, 1991

Related U.S. Application Data

[63] Continuation of Ser. No. 478,810, Feb. 12, 1990, abandoned.

[30] Foreign Application Priority Data

Feb. 18, 1989 [DE] Fed. Rep. of Germany ..... 3905082

[51] Int. Cl.[5] ..... C25B 1/14; C25B 11/06; C25B 1/22

[52] U.S. Cl. ..... 204/89; 204/290 F; 204/97; 204/103; 205/230

[58] Field of Search ..... 205/230

[56] References Cited

U.S. PATENT DOCUMENTS 3,454,478 8/1969 Carlin ..... 204/130
3,663,414 5/1972 Martinsons et al. ..... 204/290 F
4,157,943 6/1979 Scarpellino, Jr. et al. ..... 204/37 R

FOREIGN PATENT DOCUMENTS 0005674 11/1979 European Pat. Off. .
2130576 11/1972 France .

OTHER PUBLICATIONS

Translation of extract from an article in Galvanotechnik (pp. 4066–4071) "Electrodeposition of platinum by high temperature electrolysis (HTE-Pt)" by Dipl.-Ing. Gerd-Bodo Dick.

Galvanische Abscheidung von Platin durch Hochtemperaturelektrolyse (HTE-Pt) Von Dipl.-Ing. (FH) Gerd-Bodo Dick, D-7070 Galvanotechnik 79 (1988), No. 12 Schwabisch Gmund pp. 4066–4071.

*Primary Examiner*—John Niebling
*Assistant Examiner*—Kathryn Gorgos
*Attorney, Agent, or Firm*—Sprung Horn Kramer & Woods

[57] ABSTRACT

A dimensionally stable anode comprised of a) an electrically conductive valve metal b) a conductive intermediate layer and c) an electrode coating of an electrocatalytically active substance, wherein the intermediate layer comprises one or more noble metals or their alloys which have been applied to the valve metal by deposition by electroplating from melts containing noble metal salts. This anode can be used in the production alkali metal dichromates and chromic acid by electrolysis of alkali metal monochromate and/or alkali metal dichromate solutions.

7 Claims, No Drawings

DIMENSIONALLY STABLE ANODES AND THEIR USE IN THE PREPARATION OF ALKALI METAL DICHROMATES AND CHROMIC ACID

This application is a continuation of application Ser. No. 478,810, filed Feb. 12, 1990, now abandoned.

BACKGROUND OF THE INVENTION

1. Field of the Invention
2. Description of the Related Art

The invention relates to dimensionally stable anodes comprised of a) an electrically conductive valve metal
b) a conductive intermediate layer and
c) an electrode coating of an electrocatalytically active substance.

The invention, furthermore, relates to a process for the preparation of alkali metal dichromates and chromic acid by electrolysis of alkali metal monochromate and/or alkali metal dichromate solutions using the electrodes according to the invention.

Anodes which consist of an electrically conductive valve metal, such as, for example, titanium, tantalum and niobium, and are coated with an electrocatalytically active substance are used in many electrochemical processes. These anodes are generally called dimensionally stable anodes or DSA$^R$. Metals of the platinum group and oxides thereof as well as lead dioxide and manganese dioxide are chiefly employed as electrocatalytically active substances. Such anodes are described, for example, in BE-A 710 551, DE-B 2 300 422 and U.S. Pat. No. 3,711,385.

When these anodes are used in alkali metal chloride electrolysis, long running times are achieved at a low chlorine overvoltage which remains constant for a long time.

In electrolytic processes in which oxygen is formed as the main product or a by-product at the anode, the voltage increases in the course of time as a result of passivation of the anode, and the running times are considerably shorter. The cause of this passivation, which finally leads to failure of the anode, is corrosion of the valve metal by permeation of oxygen through the electrocatalytically active layer, the passivation in particular taking place very rapidly at temperatures above 60° C.

In order to improve the durability of dimensionally stable anodes which evolve oxygen, application of a conductive intermediate layer, which is said to suppress permeation of oxygen to the valve metal, between the valve metal and the electrocatalytically active layer has been proposed. This intermediate layer can consist of one or more metal oxides, such as, for example, oxides of the platinum metals or oxides of titanium, vanadium, niobium, tantalum and other base metals. Such anodes are described, for example, in DE-A 3 219 003, DE-C 3 330 388, DE-A 3 715 444 and DE-A 3 717 972. U.S. Pat. No. 3,775,284 discloses anodes which have intermediate layers of noble metals such as platinum and iridium applied by wet electroplating processes. .

Although the intermediate layers described can slow down the passivation and therefore prolong the life of the anodes, these anodes are still not sufficiently durable, especially at temperatures above 60° C.

Typical processes in which oxygen is formed at the anode are the electrolytic preparation of alkali metal dichromates, chromic acid, perchlorates, chlorates, persulphates and hydrogen peroxide, the electrolytic deposition of metals, such as chromium, copper, zinc or noble metals, and various galvanizing processes or electroplating.

Because the durability of the dimensionally stable anodes is in many cases inadequate for economic operation of the electrolytes, massive noble metal anodes are still used even today; the use of these being very cost-intensive, or heavy metal anodes, such as lead anodes, are used, these leading to contamination of the electrolytes and the associated secondary problems.

The object of the invention was to provide dimensionally stable anodes which do not have the disadvantages described.

It has now been found that anodes with an intermediate layer of noble metal which have been produced by electrolytic deposition from melts containing noble metal salts are outstandingly suitable for anodic evolution of oxygen and have long service lives.

The invention relates to dimensionally stable anodes comprised of a) an electrically conductive valve metal,
b) a conductive intermediate layer and
c) an electrode coating of an electrocatalytically active substance, which are characterized in that the intermediate layer comprising one or more noble metals and/or noble metal alloys which have been applied to the valve metal by deposition by electroplating from melts containing noble metal salts.

The production of such noble metal layers on valve metals by deposition by electroplating from melts containing noble metal salts is described, for example, in "G. Dick, Galvanotechnik 79 (1988), no. 12, p. 4066–4071". Dimensionally stable anodes, the intermediate layer comprised of a platinum and/or iridium and/or a platinum-iridium alloy are preferred. Intermediate layers of other noble metals, such as gold, silver, rhodium and palladium, their base alloys with one another and their alloys with platinum and iridium are also possible. The layer thickness of the intermediate layer according to the invention is preferably 1.5 to 30 μm, layer thicknesses of 1.5 to 5 μm being particularly preferred. However, layer thicknesses of less than 1.5 μm and more than 30 μm are also possible.

It is advantageous if the valve metal of the dimensionally stable anode be titanium, tantalium, niobium, zirconium or their alloys, titanium being preferred for cost reasons. Niobium and tantalum are used in particular if voltages above 10 V are required.

The electrode coating in principle can be of all the electrocatalytically active substances which are customary in practice. Electrode coatings of one or more oxides of titanium, tanatalum, niobium or zirconium and/or one or more oxides of the platinum metals are preferred. Such electrode coatings can be produced by means of pyrolytic processes, for example by thermal decomposition of compounds of the metals mentioned. Electrode coatings which are of a platinum oxide and/or iridium oxide are particularly preferred.

The dimensionally stable anodes according to the invention are distinguished by an outstanding stability when used in electrolytic processes in which oxygen is formed as the main product or a by-product at the anode. Even at temperatures above 60° C., the service lives of the anodes required for economic operation of electrolytic processes are achieved at oxygen overvoltages which remain constant for a long time. The dimensionally stable anodes according to the invention can of course likewise advantageously be employed at temperatures below 60° C.

The invention, furthermore, relates to a process for the preparation of alkali metal dichromates and/or chromic acid by electrolysis of alkali metal monochromate and/or alkali metal dichromate solutions, which is characterized in that a dimensionally stable anode according to the invention is employed.

According to U.S. Pat. No. 3,305,463 and CA-A 739,447, the electrolytic preparation of dichromates and chromic acid is carried out in electrolysis cells, the electrode chambers of which are separated by cation exchanger membranes. For production of alkali metal dichromates, alkali metal monochromate solutions or suspensions are passed into the anode chamber of the cell and converted into an alkali metal dichromate solution by selective transfer of alkali metal ions through the membrane into the cathode chamber. To prepare chromic acid, alkali metal dichromate or alkali metal monochromate solutions are passed into the anode chamber and converted into solutions containing chromic acid. Sodium monochromate and/or sodium dichromate is as a rule employed for these processes. In both processes, an alkaline solution containing alkali metal ions, which can consist, for example, of an aqueous sodium hydroxide solution or, as described in CA-A 739 447, of an aqueous solution containing sodium carbonate, is obtained in the cathode chamber.

Suitable anode materials according to DE-A 3 020 260 are anodes of lead and lead alloys and dimensionally stable anodes with electrocatalytically active layers of noble metals or noble metal oxides. At anode current densities of 2 to 5 kA/m$^2$ and electrolysis temperatures above 60° C., however, these anodes have only inadequate service lives for the reasons given above.

In contrast, when the anodes according to the invention are employed, long service lives at a constant cell voltage are achieved.

Those dimensionally stable anodes which are comprised of a) titanium, b) an intermediate layer, applied by electroplating from the melt, of platinum and/or iridium and/or a platinum-iridium alloy and c) an electrode coating of a platinum and/or iridium oxide, are preferably employed.

The invention is illustrated in more detail with the aid of the following examples:

EXAMPLES

The electrolysis cells used in the examples consisted of anode chambers of pure titanium and cathode chambers of stainless steel. Cation exchanger membranes from DuPont called Nafion$^R$324 were used as the membranes. The cathodes consisted of stainless steel and the anodes of titanium with the electrocatalytically active coatings described in the individual examples. The distance between the electrodes and the membrane was in all cases 1.5 mm. Sodium dichromate solutions containing 800 g/l $Na_2Cr_2O_7 \cdot 2\ H_2O$ were passed into the anode chamber. The rate of introduction was chosen so that a molar ratio of sodium ions to chromium(VI) of 0.6 were established in the anolytes leaving the cells. Water was fed to the cathode chambers at a rate such that 20% sodium hydroxide solution left the cells. The electrolysis temperature was in all cases 80° C. and the current density was 3 kA/m$^2$ projected front area of the anodes and cathodes.

EXAMPLE 1

A titanium anode with an iridium layer which was produced by the so-called stoving process as follows was employed in this example: A titanium electrode with a front projected area of 11.4 cm×6.7 cm was wetted, after removal of the oxide layer and etching with oxalic acid, with a solution of the following composition using a hair brush:

0.8 g $IrCl_4 \cdot XH_2O$ (51% Ir)

6.2 ml 1-butanol 0.4 ml 37% hydrochloric acid 3 ml tetrabutyl titanate

The wetted anodes were dried at 250° C. for 15 minutes and then tempered in an oven at 450° C. for 20 to 30 minutes. This measure was repeated six times, the temperating being carried out only after every second step, after wetting and drying had been carried out.

An electrode coating which contained about 200 mg iridium was in this way produced on the titanium electrode. A sodium dichromate solution was converted into a solution containing chromic acid with the aid of this anode. During the experiment, the cell voltage rose gradually from initially 4.4 V to 8.1 V in the course of 32 days. The reason for this increase in voltage was almost complete destruction of the electrocatalytically active platinum layer on the titanium anode.

EXAMPLE 2

In this example, a dimensionally stable anode according to the invention which was prepared as follows was employed.

A titanium electrode coated with platinum by deposition by electroplating from a platinum-containing melt and with a front projected area of 11.4cm×6.7 cm and a platinum layer thickness of 2.5 μm was wetted with a solution of the following composition using a hair brush:

0.8 g $IrCl_4 \cdot XHO$ (51% Ir)

6.2 ml 1-butanol 0.4 ml 37% hydrochloric acid

The wetted anode was dried at 250° C. for 15 minutes and then tempered in an oven at 450° C. for 20 to 30 minutes. This measure was repeated six times, the tempering being carried out only after every second step, after wetting and drying had been carried out. An electrode coating which contained about 200 mg iridium was in this way produced on the platinum intermediate layer of the titanium electrode.

A sodium dichromate solution was converted into a solution containing chromic acid using this anode. A constant cell voltage of 3.8 V was established over the duration of the experiment of 250 days, which shows that no passivation of the anode occurred and the electrocatalytically active layer was thus completely functional throughout the entire experimental period.

EXAMPLE 3

A dimensionally stable titanium anode, the electrocatalytically active layer of which consisted exclusively of a platinum layer deposited by elecroplating from the melt was employed in this example. The thickness of the platinum layer was 2.5 μm.

A sodium dichromate solution was converted into a solution containing chromic acid as in example 1 and 2, under identical conditions, using this anode.

A constant cell voltage 4.8 V was established over the duration of the experiment of 361 days. No passivation of the anode thus occurred. Comparison with example 2 shows, however, that the anode of example 3 has a significantly higher oxygen voltage.

What is claimed is:

1. A dimensionally stable anode comprised of a) an electrically conductive valve metal b) a conductive intermediate layer and c) an electrode coating of an electrocatalytically active substance, wherein the improvement comprises the intermediate layer is comprised of one or more noble metals or noble metal alloy or a mixture of one or more noble metals and noble metal alloy which have been applied to the valve metal by deposition by electroplating from melts containing noble metal salts.

2. A dimensionally stable anode according to claim 1, wherein the intermediate layer is a platinum alloy or iridium alloy or a platinum-iridium alloy.

3. A dimentionally stable anode according to claim 1, wherein the layer thickness of the intermediate layer is 1.5 to 5 μm.

4. A dimensionally stable anode according to claim 1, wherein the valve metal is titanium, tantalum, niobium, zirconium or their alloys.

5. A dimensionally stable anode according to claim 1, wherein the electrode coating is one or more oxides of the platinum metals.

6. A dimensionally stable anode according to claim 1, wherein the electrode coating is of a platinum oxide or iridium oxide or a mixture of a platinum oxide and an iridium oxide.

7. In a process for the preparation of alkali metal dichromates and chromic acid by electrolysis of alkali metal monochromate or alkali metal dichromate solutions, wherein the improvement comprises the electrolysis is conducted using a dimensionally stable anode according to claim 1.

* * * * *